US010451379B2

(12) United States Patent
Heckert et al.

(10) Patent No.: US 10,451,379 B2
(45) Date of Patent: Oct. 22, 2019

(54) AIR GUN WITH ADJUSTABLE TRIGGER MECHANISM

(71) Applicant: Sig Sauer, Inc., Newington, NH (US)

(72) Inventors: Justin Daniel Heckert, Newmarket, NH (US); Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/910,146

(22) Filed: Mar. 2, 2018

(65) Prior Publication Data

US 2018/0252493 A1 Sep. 6, 2018

Related U.S. Application Data

(60) Provisional application No. 62/466,222, filed on Mar. 2, 2017.

(51) Int. Cl.
*F41B 11/70* (2013.01)
*F41B 11/648* (2013.01)

(52) U.S. Cl.
CPC ..... *F41B 11/70* (2013.01); *F41B 11/648* (2013.01)

(58) Field of Classification Search
USPC ..... 124/31, 37, 38
See application file for complete search history.

(56) References Cited

U.S. PATENT DOCUMENTS

2006/0010747 A1* 1/2006 Tasyagan ..... F41A 17/48 42/69.03

OTHER PUBLICATIONS

"Air Gun", Retrieved on Internet on Feb. 18, 2017 from URL: https://en.wikipedia.org/wiki/Air_gun, Feb. 2017, 10 pages.
"Pellet (air gun)", Retrieved on Internet on Feb. 18, 2017 from URL: https://en.wikipedia.org/wiki/Pellet_(air_gun), Aug. 2016, 3 pages.
"Sear (firearm)", Retrieved on Internet on Feb. 18, 2017 from URL: https://en.wikipedia.org/wiki/Sear_(firearm), Oct. 2016, 2 pages.
"Trigger (firearms)", Retrieved on Internet on Feb. 18, 2017 from URL: https://en.wikipedia.org/wiki/Trigger_(firearm), Dec. 2016, 8 pages.

* cited by examiner

*Primary Examiner* — Reginald S Tillman, Jr.
(74) *Attorney, Agent, or Firm* — Finch & Maloney PLLC

(57) ABSTRACT

Techniques and componentry are disclosed for an air gun with an adjustable trigger mechanism. The air gun includes a cylinder attached to a barrel and a trigger mechanism. The trigger mechanism includes a sear operatively coupled to a trigger bar and configured to release a piston disposed within the cylinder in response to operating the trigger mechanism. Operatively coupled to the trigger bar is a trigger blade that includes a trigger stage bracket. The trigger stage bracket provides a second pull stage that operates with more resistance than a first pull stage during trigger blade movement. An adjustment screw is disposed within the trigger blade and is in contact with the trigger stage bracket. The adjustment screw positions the trigger stage bracket relative to the trigger blade to adjust a distance at which the trigger blade transitions from the first pull stage to the second pull stage.

9 Claims, 16 Drawing Sheets

AIR GUN WITH ADJUSTABLE TRIGGER MECHANISM

CROSS-REFERENCE TO RELATED APPLICATIONS

This application claims the benefit of U.S. Provisional Patent Application No. 62/466,222, filed on Mar. 2, 2017, which is herein incorporated by reference in its entirety.

FIELD OF THE DISCLOSURE

This disclosure relates to air guns, and more particularly to air guns with an adjustable trigger mechanism.

BACKGROUND

Air guns are small arms, such as air pistols or rifles, that are commonly used for hunting, recreational shooting (known as plinking), and competitive shooting, such as field target events. Unlike conventional firearms that fire projectiles using chemical or explosive reactions, air guns utilize mechanically pressurized air or gas to propel projectiles (e.g., pellets or small balls called "BBs"). For instance, air guns, such as spring-piston air guns, use a mechanical means (e.g., a spring and piston) to compress air within a cylinder. When released the compressed air causes the projectile to be launched or otherwise propelled from the barrel of the air gun. Other air gun designs, such as compressed-gas guns or pneumatic air guns, utilize prefilled removable gas cylinders or an internal reservoir containing air pressurized by an on-board pump. In such instances, the internally stored pressurized air or gas (e.g., $CO_2$) is the source of energy to propel the projectile.

SUMMARY

One example embodiment of the present disclosure provides an air gun including a barrel attached to a cylinder; and a trigger mechanism including a sear operatively coupled to a trigger bar, the sear is configured to release a piston disposed within the cylinder in response to operating the trigger mechanism, a trigger blade operatively coupled to the trigger bar and including a trigger stage bracket, the trigger stage bracket to provide a first pull stage and a second pull stage, wherein the second pull stage operates with more resistance force than the first pull stage during movement of the trigger blade, and an adjustment screw disposed within the trigger blade and in contact with the trigger stage bracket, the adjustment screw to position of the trigger stage bracket relative to the trigger blade to adjust a distance at which the trigger blade is to transition from the first pull stage to the second pull stage. In some cases, the trigger stage bracket includes a first stage feature in contact with trigger bar during the first pull stage, and a second stage feature in contact with the trigger bar during the second pull stage. In such cases, the first stage feature is in contact with the trigger bar and the second stage feature is not in contact with the trigger bar while the trigger blade is operated through the first pull stage. In yet other cases, the first stage feature and the second stage feature are in contact with the trigger stage bracket at the distance at which the trigger blade is to transition from the first pull stage to the second pull stage. In some other cases, the first stage feature and the second stage feature are curvilinear surfaces. In yet other such cases, at least one of the first stage feature and the second stage feature includes a rotating bearing element. In other cases, contact between the trigger bar and the trigger stage bracket is along a surface of at least one of the first stage feature and the second stage feature. In some other cases, the trigger blade is configured to limit movement of the trigger stage bracket relative to the trigger blade. In yet other cases, the trigger mechanism includes only one adjustment screw to adjust the distance at which the trigger blade is to transition from the first pull stage to the second pull stage.

Another example embodiment of the present disclosure provides an air gun including a barrel attached to a cylinder; and a trigger mechanism including a sear operatively coupled to a trigger bar, the sear is configured to release a piston disposed within the cylinder in response to operating the trigger mechanism, and a trigger adjustment assembly operatively coupled to the trigger bar, and including a stem attached to the trigger bar, a spring having a first end and a second end, wherein the first end is positioned onto the stem so as to constrain movement of the spring in a first direction along the stem, an adjustment collar coupled to the stem and to receive the second end of the spring, wherein the adjustment collar is to constrain movement of the spring in a second direction along the stem, an adjustment cap coupled to the adjustment collar, wherein the adjustment collar is positioned relative to the stem by rotating the adjustment cap, and a plug attached to the cylinder to receive the adjustment cap. In other instances, the plug includes an opening in which to adjust the trigger mechanism from a top of the air gun. In some other instances, the adjustment cap is rotated to adjust a resistance force at which a trigger blade is operated with during at least one of a first pull stage and a second pull stage. In other such instances, the resistance force is increased or decreased by rotating the adjustment cap relative to the plug. In other instances, the plug includes at least one tab, the at least one tab is to engage at least one groove within the adjustment cap. In other such instances, the adjustment cap is prevented from rotating relative to the plug when the at least one tab of the plug is engaged with the at least one groove of the adjustment cap. In yet other instances, the plug includes at least one groove, the at least one groove is to engage at least one tab on the adjustment cap. In some other instances, the stem includes a plurality of tabs that engage with the adjustment collar to prevent the adjustment collar from rotating about the stem. In other such instances, the adjustment collar is to movable relative to the stem in the first direction or the second direction upon the rotating the adjustment cap. In other instances, the stem is to move axially within the adjustment collar and rotate relative to the trigger bar in response to operating a trigger blade of the trigger mechanism. In yet other instances, the trigger adjustment assembly applies a force to the trigger bar causing a trigger blade to be operated with a resistance force that is substantially constant during a first pull stage and a second pull stage, wherein the resistance force increases at a distance during movement of the trigger blade at which the trigger blade transitions from the first pull stage to the second pull stage.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
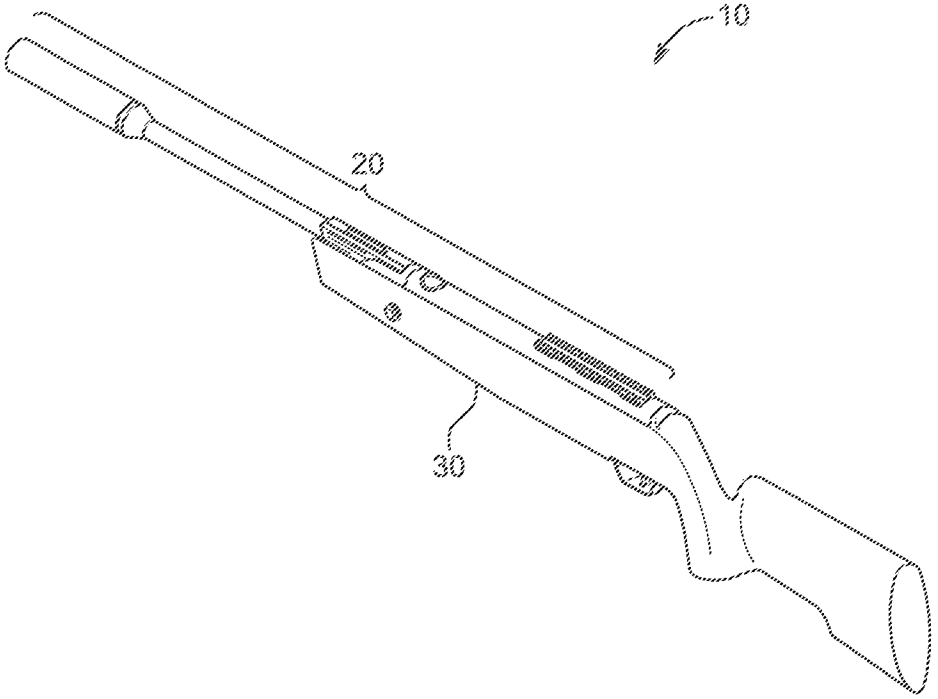
FIG. 1 is a perspective view of an air gun configured in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

Techniques and componentry are disclosed for an air gun, such as an air rifle, with an adjustable trigger mechanism. The air gun includes a compression cylinder with a barrel and an adjustable trigger mechanism attached thereto. The trigger mechanism includes a sear operatively coupled to a trigger bar and a trigger assembly. The sear is configured to release a piston disposed within the compression cylinder to fire the air gun. The piston is released in response to the user operating (e.g., grasping and pulling) the trigger assembly causing both the trigger bar and sear to move. The trigger assembly includes a trigger blade (e.g., a lever) with a trigger stage bracket disposed thereon. The trigger stage bracket is in contact with the trigger bar, such that movement of the trigger blade causes the trigger bar and sear to move, which in turn causes the air gun to fire. With the trigger stage bracket disposed on the trigger blade, the trigger blade can be operated as a single or a double pull stage trigger utilizing a single adjustment screw. The position of the adjustment screw determines not only the type of pull (e.g., single or double), but also the distance at which the trigger blade transitions from the first pull stage to the second pull stage.

The trigger mechanism can further include a trigger adjustment assembly that enables a user to maintain the resistance during a first pull stage and a second pull stage to achieve a particular feel when operating the trigger assembly as a double pull stage trigger. The trigger adjustment assembly is operatively coupled to the trigger bar causing the trigger bar to oppose the movement of the trigger blade. Depending on its configuration, the trigger adjustment assembly maintains a substantially constant or otherwise nearly uniform resistance (or trigger pull) during each of the first and second pull stages. Note that during movement of the trigger blade, the resistance is to increase as the trigger blade transitions from the first to the second pull stage. As a result, the user can operate the trigger mechanism while knowing in which pull stage the trigger blade is currently moving through based on an amount of resistance (trigger pull) the user is experiencing. Moreover, the transition can identify to the user that the trigger blade is nearing the distance at which it will fire the air gun.

General Overview

Air guns benefit from a high level of accuracy, especially for competitive shooting or hunting, to ensure that the projectile fired from the gun contacts the intended target. In some cases, air guns may include adjustable components for achieving a desired feel that is comfortable to a user when operating the air gun. Adjustability, however, often leads to reduced accuracy because the adjustable components can wear over time and thus may not maintain their adjusted position. Moreover, improper adjustments (e.g., over adjusting components) performed by inexperienced or unsophisticated users can also reduce air gun accuracy or even cause an unsafe air gun condition (e.g., an excessively short trigger pull). For instance, adjustable triggers often include two screws for making adjustments. The screws are in direct contact (e.g., point contact) with the trigger bar, which in turn produces friction that can cause components to wear more easily. Worn trigger components (e.g., rounded screw tips or damaged trigger bar surfaces) can decrease the quality of the trigger pull because the components may move over time due to forces (e.g., vibrational forces) generated while firing the air gun. This movement can result in trigger components no longer being in their initially adjusted position, and thus altering the operation or feel of the trigger. Moreover, such adjustable triggers are not intuitive, because users are often unsure which screw to adjust and do not understand how adjusting one screw may affect adjustments made with the other. Thus, such adjustable triggers can result in improper adjustments, which in turn, can cause damage to trigger components or an unsafe condition.

Some adjustable triggers include springs for adjusting resistance experienced by a user while operating the trigger. These springs, however, are typically high rate springs (e.g., a spring with a large spring constant) that deflect only a small amount. The limited deflection of these springs is caused by a high spring rate and the short spring length that is necessary to fit within the limited space within the trigger. As a result, these adjustable triggers provide a limited amount of adjustment because the spring can be deflected a very small amount. In addition, the spring is typically accessible from the bottom of the air gun, which is inconvenient for users when making adjustments because users need to put down the gun and rotate it to access the spring.

Thus, and in accordance with an embodiment of the present disclosure, techniques and componentry are disclosed for an air gun, such as an air rifle, with an adjustable trigger mechanism. The air gun includes a barrel pivotally attached to a compression cylinder. When pivoted down to compress the air cylinder, the barrel is configured to receive a projectile, such as a pellet, within its breech end. Once loaded with a projectile, the barrel can be rotated upward to align the barrel with the compression cylinder to place the air gun in the ready-to-fire (or cocked) position. In the ready-to-fire position, a piston (e.g., a pump piston) disposed within the compression cylinder is retracted and held in place by a trigger mechanism. When released, the piston moves rapidly forward within the compression cylinder in response to a force applied by a mechanical source (e.g., a spring or strut). As the piston moves along the cylinder, the air pressure within the forward portion of the compression cylinder increases, until the high-pressure air created by the movement of the piston causes the projectile to be propelled from the barrel.

The trigger mechanism, in an example embodiment, is an adjustable trigger mechanism that includes a sear operatively coupled to a trigger bar and a trigger assembly. The trigger bar maintains the sear in the ready to fire position, until the trigger assembly is operated causing the trigger bar to rotate around a pivot point. With the trigger bar rotated, the sear can release the piston disposed within the compression cylinder, causing the air gun to fire. The trigger assembly includes a trigger blade, for example a lever, which can be grasped and pulled by a user. Disposed on the trigger blade is a trigger stage bracket. The trigger stage bracket is in contact with the trigger bar, such that movement of the trigger blade causes the trigger bar to rotate, which in turn begins the firing cycle, as described above.

With the trigger stage bracket disposed on the trigger blade, the trigger blade can be operated as either a single or a double pull stage trigger depending on the position of a single adjustment screw. A single pull stage trigger is a trigger assembly that can be operated such that the user experiences a substantially constant or otherwise nearly uniform resistance (or pull force) throughout the movement of the trigger. A double (or two) pull stage trigger, in contrast, is a trigger assembly that can be operated such that the user experiences non-uniform resistance, for example two different amounts of resistance, during trigger movement. The first pull stage allows the user to easily operate the trigger while aiming the gun at the target, but without firing the air gun. After operating the trigger blade through the first pull stage, the trigger blade can be operated through a second (or final) pull stage having greater resistance, and thus providing the user with a heavier trigger feel. The second pull stage indicates to the user that trigger blade is nearing the distance at which the trigger assembly will fire the air gun.

Disposed within the trigger blade is an adjustment screw (e.g., a set screw). The adjustment screw is in contact with the trigger stage bracket and positions (e.g., raises or lowers) the trigger stage bracket relative to the trigger blade to operate the trigger assembly in either a single stage or a double stage pull. The position of the adjustment screw determines not only the type of pull (e.g., single or double), but also the distance at which the trigger blade transitions from the first pull stage to the second pull stage, and thus allows a user to achieve a particular trigger feel (e.g., heavy, light, or somewhere in between) based on the user's desired preference. When configured as a double pull stage trigger, the trigger blade can be operated through a first (or initial) pull stage that has less resistance, and thus providing the user with a lighter trigger feel.

The trigger mechanism can further include a trigger adjustment assembly operatively coupled to the trigger bar. The trigger adjustment assembly enables a user to adjust the resistance during a first and optionally a second pull stage. Thus, the resistance can be substantially constant or otherwise nearly uniform during the first and second pull stages until the trigger blade is moved to a distance in its travel at which the trigger assembly transitions from the first pull stage to the second pull stage (e.g., a transition point or distance). At this distance, the resistance for the first pull stage can increase to the resistance force of a second pull stage. This increase in resistance at the transition distance allows a user to know that the trigger blade is traveling through the second pull stage, and thus nearing the distance at which it fires the air gun.

The trigger adjustment assembly can include an adjustable stem operatively coupled to the trigger bar. The stem transmits the force generated by the trigger adjustment assembly to the trigger bar to oppose the movement of the trigger blade, and thus can be used to maintain the resistance (or trigger pull) experienced by a user while operating the trigger blade through each of the first and second pull stages. Disposed on the stem are a spring and an adjustment collar. The spring is constrained from moving in a first direction along the stem by a collar located at one end of the stem. At the other end of the stem, the adjustment collar constrains the movement of the spring in a second direction along the stem and opposite the first direction. Coupled to the adjustment collar is an adjustment cap. The adjustment cap can be rotated causing the adjustment collar move up and down along the stem. In response to movement of the adjustment collar, the spring can either be compressed or relaxed causing an increase or decrease in the force applied to the trigger bar. The adjustment cap is held in position by a plug attached to the cylinder. The plug is configured to receive the adjustment cap and prevent it from rotating. The plug may include an opening that provides a user with access to the trigger adjustment assembly from the upper surface of the air gun. From the top of the gun, a user can make adjustments to the trigger adjustment assembly by depressing and rotating the adjustment cap. With the adjustment cap depressed against the force of the spring and free from one or more locking features within the plug, the adjustment cap can be rotated, for example in discrete increments or steps, in either direction to adjust the force applied to the trigger bar. Once rotated to a desired position, the adjustment cap can be released causing it seat itself within the locking features of the plug.

Example Air Gun Application

FIG. 1 is a perspective view of an air gun 10 configured in accordance with an embodiment of the present disclosure. In a general sense, an air gun is a small arm (e.g., a pistol or rifle) that propels projectiles by means of mechanically pressurized air or other gas. Air guns typically propel plastic or metallic projectiles, for example, non-spherical hollow pellets, or spherical balls, called BBs. The air gun 10 may be configured in a variety of calibers including, but not limited to .177 (4.5 mm) and .22 (5.5 mm & 5.6 mm) calibers. In an example embodiment, the air gun 10 includes an action assembly 20 and a stock 30. The action assembly 20 enables a user to load the air gun 10 and make it ready for firing. Attached to the action assembly 20 is a stock 30. Stock 30 is the portion of air gun 10 that is held by a person when firing or otherwise shooting the gun 10.

Figure 2:
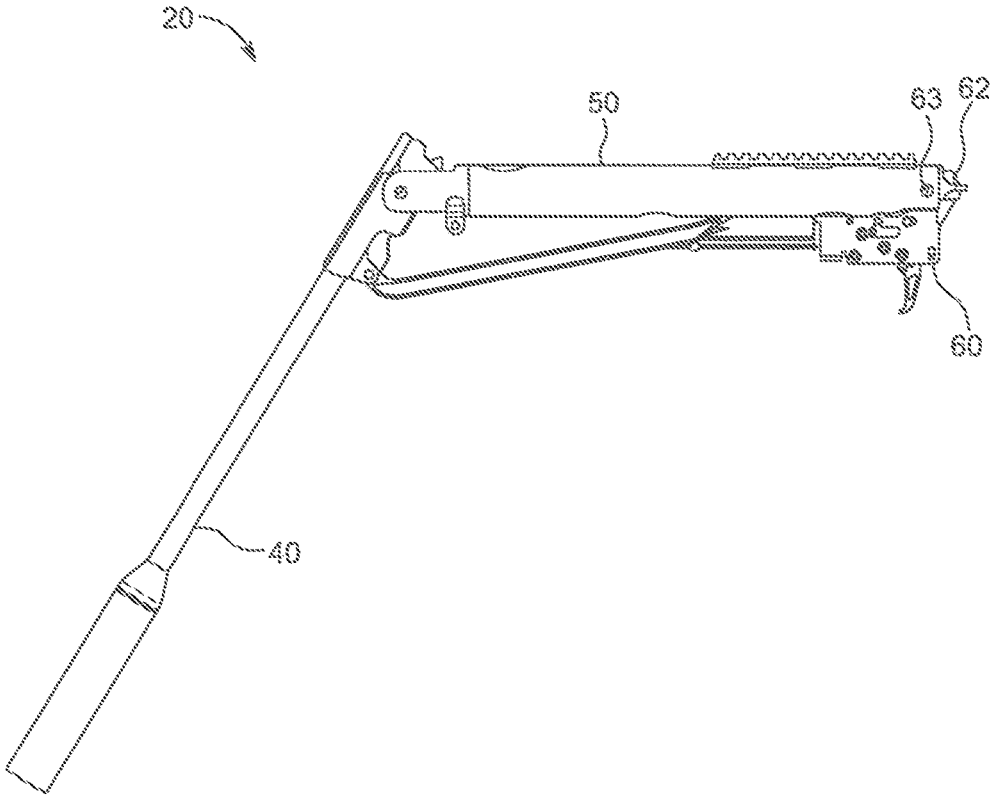
FIG. 2 is a side view of an action assembly of the air gun shown in FIG. 1, in accordance with an embodiment of the present disclosure.

FIG. 2 is a side view of an action assembly 20 of the air gun 10 shown in FIG. 1, in accordance with an embodiment of the present disclosure. The action assembly 20, as previously mentioned, allows a user to load and make the air gun 10 ready for firing. In an example embodiment, the action assembly 20 includes a barrel 40, a compression cylinder 50, a trigger mechanism 60, and a piston plug 62 attached to the compression cylinder 50 using pin 63. The barrel 40 is configured to receive a projectile during loading of the firearm. In the example embodiment, the barrel 40 is pivotally connected to the compression cylinder 50, such that, once loaded, the barrel 40 can be positioned in alignment with the compression cylinder 50, which in turn cocks or otherwise readies the air gun 10 for firing.

Attached to the barrel 40 is a compression cylinder 50 that is separate from the barrel 40. The compression cylinder 50 can include a spring-loaded piston pump assembly that provides a source of air or gas pressure to propel the projectile through the barrel 40. Disposed at an end of the compression cylinder 50 (the end opposite where the barrel 40 is attached) is a piston plug 62. The piston plug 62 is secured to the compression cylinder 50 using a pin 63, such that the piston plug 62 remains fixed relative to the compression cylinder 50. Piston plug 62 is to receive the end of the piston, such that spring-loaded piston pump assembly can be placed in the ready to fire or cocked position. In addition, the piston plug 62 also maintains the position a trigger adjustment assembly relative to the trigger mechanism 60, as will be described further herein.

The compression cylinder 50 is operatively coupled to a trigger mechanism 60. Trigger mechanism 60 is the device that maintains the piston pump assembly of the compression cylinder 50 in the cocked or ready to fire position. Trigger mechanism 60 also actuates or otherwise begins the firing sequence for the air gun 10, thereby causing the projectile to be propelled through the barrel 40. In more detail, a user can cock the air gun 10, which in turn causes the pump piston within the compression cylinder 50 to move backwards compressing the spring of the piston pump assembly. At the end of this operation, a sear of the trigger mechanism 60 engages the pump piston to maintain the piston in a cocked or ready to fire position. The breech can be loaded with a projectile and the barrel rotated back up to a closed position, and thus completing the cocking action. Once in the ready to fire position, a trigger of the trigger mechanism 60 can be manipulated (e.g., pulled) to disengage the sear from the pump piston, and thus causing the piston to move forward within the compression cylinder 50, thereby compressing the air in front of the piston within the compression cylinder 50. The compressed air escapes or otherwise moves through an outlet within the compression cylinder 50 (located in front of the piston pump and directly behind a projectile positioned in the barrel 40), which in turn applies a force on the projectile that overcomes the static frictional forces between the projectile and the barrel 40, and thus causing the projectile to be propelled forward through the barrel 40.

Example Adjustable Trigger Assembly

Figure 3A:
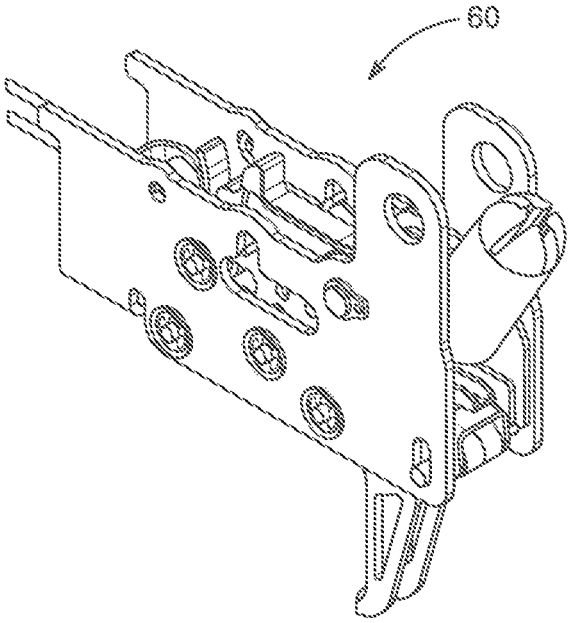
FIG. 3A is a perspective view of a trigger mechanism of the action assembly shown in FIG. 2, in accordance with an embodiment of the present disclosure.
Figure 3B:
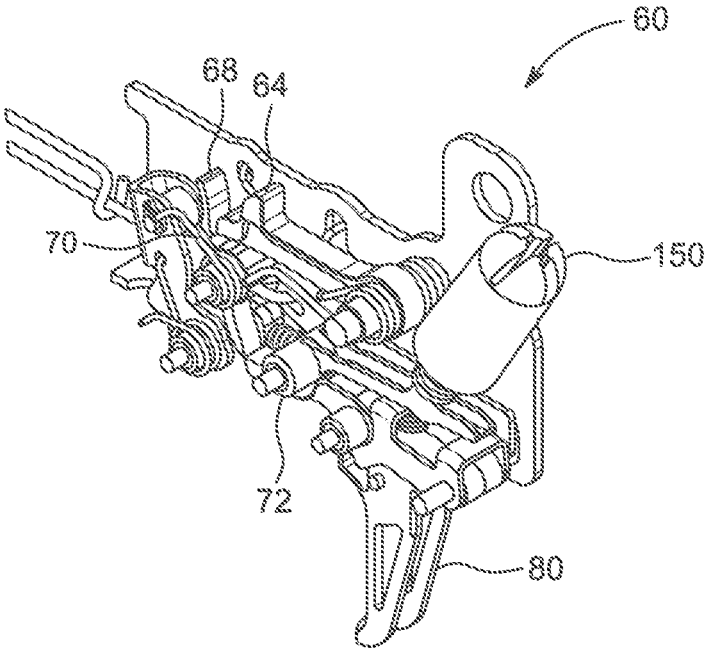
FIG. 3B is a perspective view of the trigger mechanism shown in FIG. 3A with a housing piece removed from the mechanism, in accordance with an embodiment of the present disclosure.
Figure 3C:
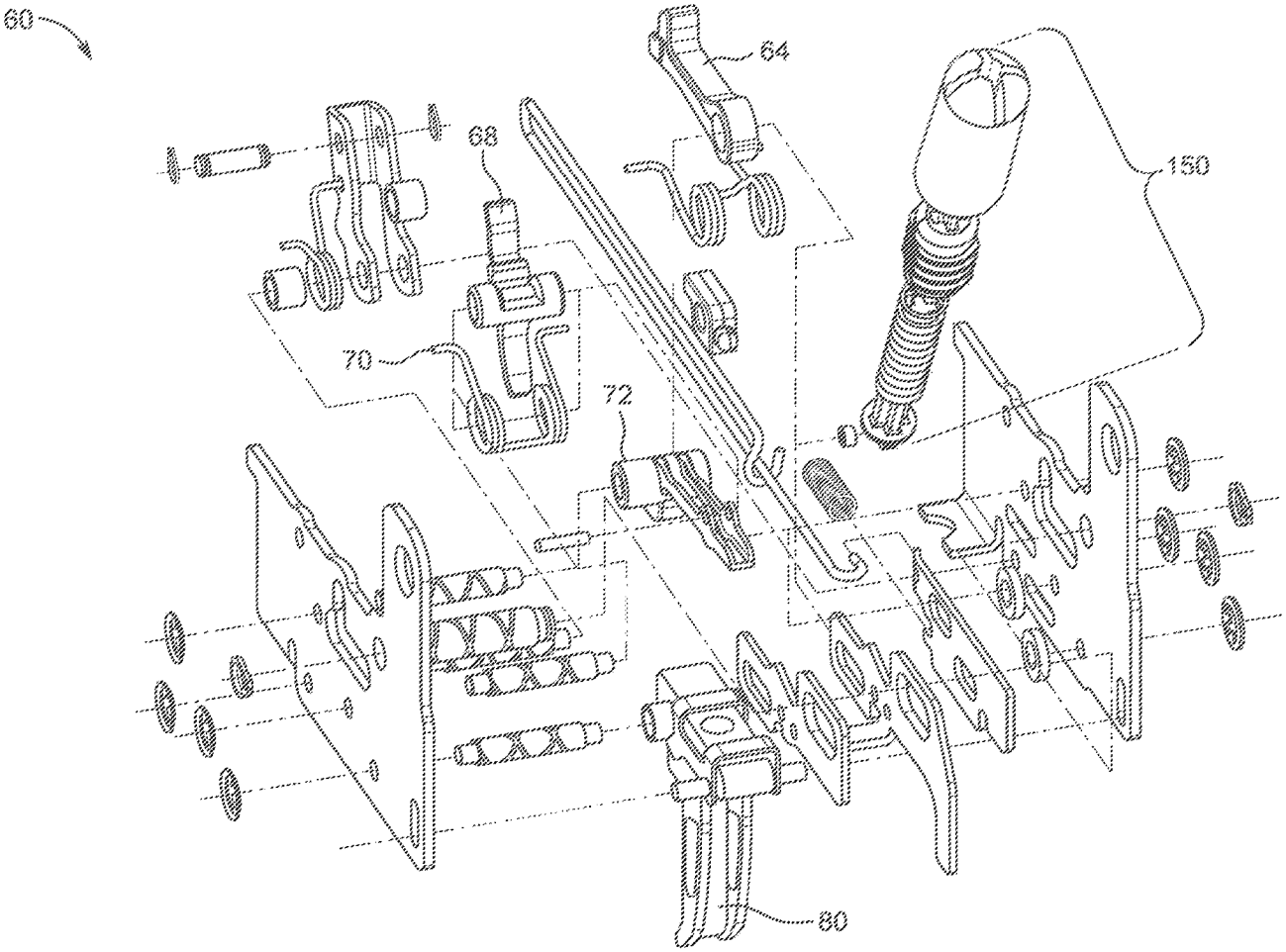
FIG. 3C is an exploded view of the trigger mechanism shown in FIG. 3A, in accordance with an embodiment of the present disclosure.
Figure 3D:
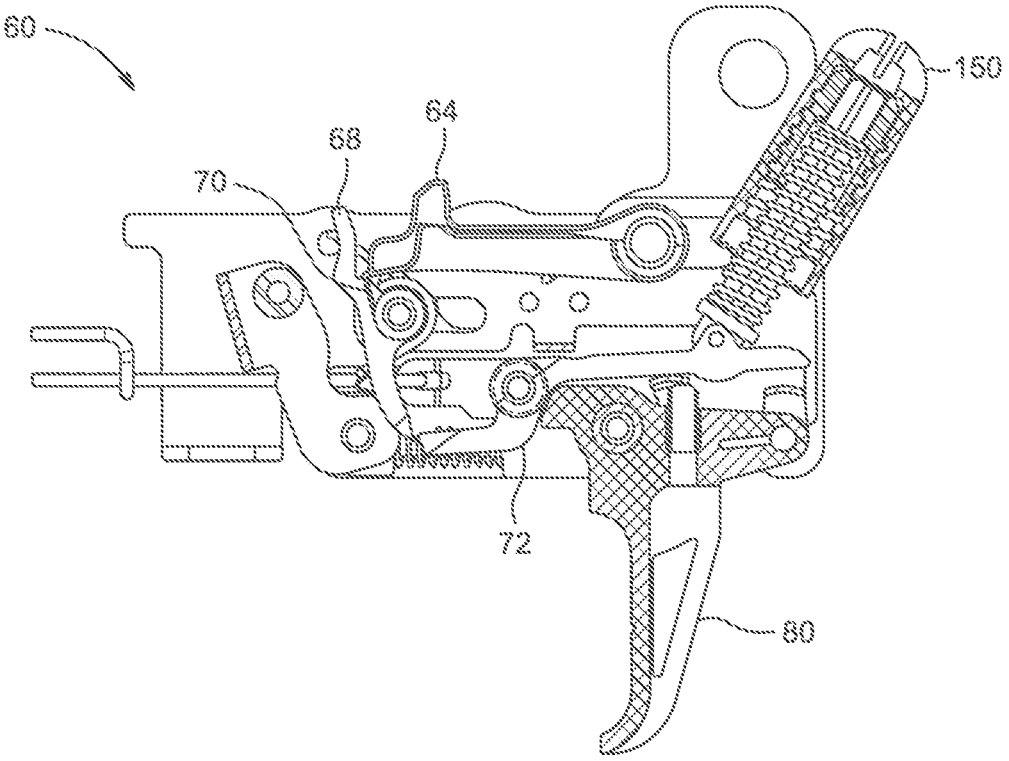
FIG. 3D is a cross-sectional view of the trigger mechanism shown in FIG. 3A, in accordance with an embodiment of the present disclosure.

FIG. 3A is a perspective view of a trigger mechanism 60 shown in FIG. 2, in accordance with an embodiment of the present disclosure. FIG. 3B is a perspective view of the trigger mechanism shown in FIG. 3A with a housing piece removed from the mechanism. FIG. 3C is an exploded view of the trigger mechanism shown in FIG. 3A. FIG. 3D is a cross-sectional view of the trigger mechanism shown in FIG. 3A. Trigger mechanism 60, in accordance with an example embodiment, can be adjusted utilizing a single adjustment screw to provide a first pull stage and a second pull stage of the trigger when firing the air gun 10. A pull stage is the distance the trigger blade is moved and having a particular resistance associated with it (e.g., a heavy or light feeling trigger pull). The first pull stage can be operated with less resistance than the second pull stage to cause the user to experience a difference in trigger pull (e.g., a feeling that the trigger pull is heavier during the second pull stage). The first and second pull stages allow a user to initially operate the trigger mechanism 60 while the user is sighting the air gun 10 onto the target. Difference in feel experienced by the user during the two pull stages, allows the user to know that the trigger blade is nearing the distance at which it will cause the gun 10 to fire. As previously described, the trigger mechanism 60 maintains the air gun 10 in the cocked or ready to fire position and also actuates the firing cycle. In an example embodiment, the trigger mechanism 60 includes a sear 64, a sear support 68, a trigger bar 72, and a trigger assembly 80. Sear 64, as previously mentioned, is the part of the trigger mechanism 60 that holds or otherwise engages the pump piston within the compression cylinder 50. The sear 64 maintains the pump piston in the ready to fire position until the trigger assembly 80 is operated by the user, as will be described further herein.

As shown in FIG. 3D, sear 64 is held in position by a sear support 68 that is operatively coupled to a trigger bar 72. The sear support 68 is engaged with the trigger mechanism 60 via a spring 70. The spring 70 biases the sear support 68 to rotate in a forward direction and away from the sear 64. With the sear support 68 no longer in contact with the sear 64, the sear 64 moves downward and is no longer engaged with the pump piston. When in the ready to fire position, trigger bar 72 engages one end of the sear support 68 and prevents it from rotating forward. The trigger adjustment spring biases the trigger bar 72 in the vertical direction to maintain the sear 64 in the ready to fire position. To cause the sear 64 to move and in turn fire the air gun 10, the trigger assembly 80 is to be manipulated by a user. The trigger assembly 80 is operatively coupled to the trigger bar 72, such that when assembly 80 is operated the trigger bar 72 rotates (e.g., in a downward direction) causing the upper portion of sear support 68 to be rotated forward by the spring 70 attached thereto. Once sear support 68 is rotated, the sear 64 is no longer supported by the sear support 68, and the sear 64 rotates downward and is no longer in contact with the pump piston. With the sear 64 no longer retaining the pump piston in place, the air gun 10 begins its firing cycle.

Figure 4A:
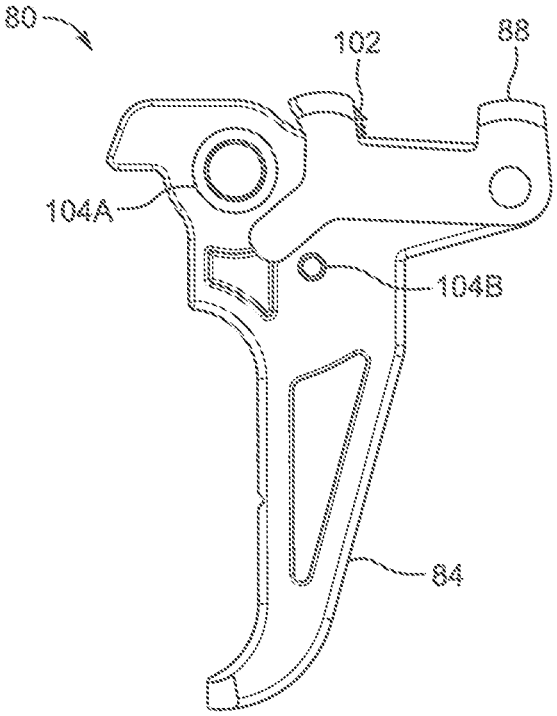
FIG. 4A is a side view of a trigger assembly configured in accordance with an embodiment of the present disclosure.
Figure 4B:
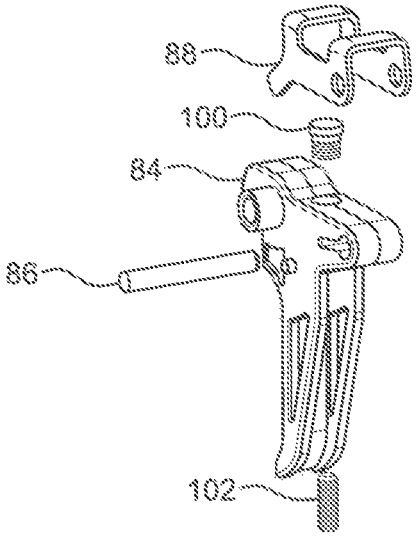
FIG. 4B is an exploded view of a trigger assembly shown in FIG. 4A, in accordance with an embodiment of the present disclosure.
Figure 4C:
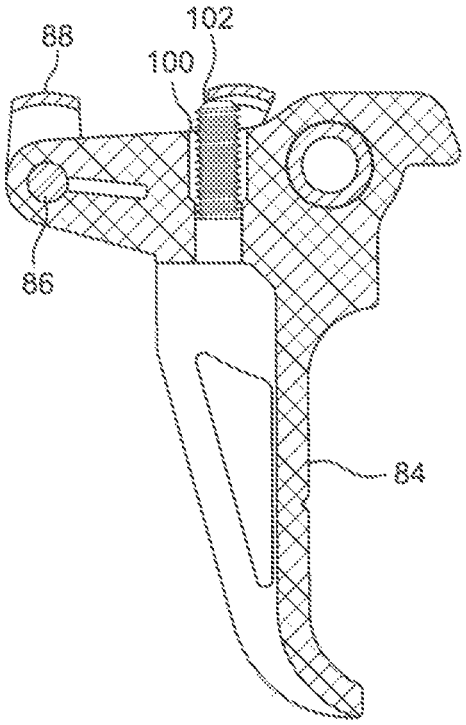
FIG. 4C is a cross-sectional view of the trigger assembly shown in FIG. 4A, in accordance with an embodiment of the present disclosure.

FIG. 4A is a side view of a trigger assembly 80 configured in accordance with an embodiment of the present disclosure. FIG. 4B is an exploded view of a trigger assembly 80 shown in FIG. 4A. FIG. 4C is a cross-sectional view of the trigger assembly 80 shown in FIG. 4A. The trigger assembly 80 is the component that is operated by a user causing the trigger mechanism 60 to actuate the firing sequence for the air gun 10. In an example embodiment, the trigger assembly 80 includes a trigger blade 84, a pin 86, a trigger stage bracket 88, an insert 100, and an adjustment screw 102. Trigger blade 84 is the part of the trigger assembly 80 that interfaces with the user (e.g., the user pulls or wraps a finger around) to fire the air gun 10. In an example embodiment, the trigger blade 84 is guided in the housing of the trigger mechanism 60 using a pin 86, such that the horizontally oriented pin 86 can move in a vertical direction within the housing in response to the trigger blade 84 being pulled backwards by a user. As can be seen, the trigger blade 84 is a lever that can be pulled using a finger of a user's hand. In a general sense, the trigger blade 84 can be any shape so long as the user can comfortably grasp and operate the trigger mechanism 60. As can be seen, the trigger blade 84 can include one or more projections or protrusions that engage with the stage bracket 88, as will be described further herein. Such projections can limit movement of the stage bracket 88, and thereby prevent a user from over or otherwise incorrectly adjusting the trigger assembly 80.

Figure 5:
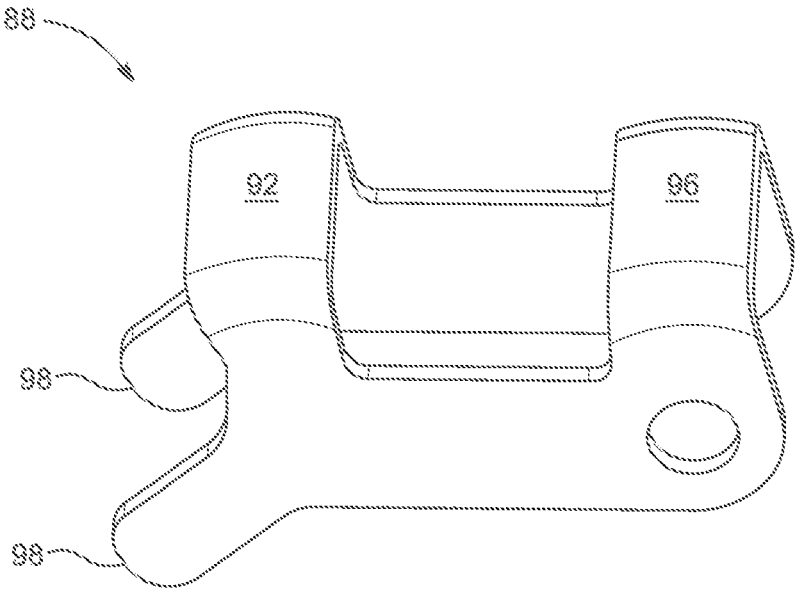
FIG. 5 is a perspective view of a trigger stage bracket configured in accordance with an embodiment of the present disclosure.

Disposed on the trigger blade 84 is a trigger stage bracket 88. Trigger stage bracket 88 (hereinafter referred to as stage bracket 88) contacts the trigger bar 72 in response to moving the trigger blade 84, and thus begins the firing cycle for the air gun 10. As shown in the example embodiment of FIG. 5, the stage bracket 88 includes a first stage feature 92 and a second stage feature 96. As can be seen, the first stage feature 92 and second stage feature 96 can be curvilinear surfaces that are configured to contact the trigger bar 72, at multiple places (e.g., two or more) on each surface (e.g., along a line that is parallel to the axis of rotation of the trigger assembly 80) rather than at a single point. Such multiple point or line, or surface contact provides for improved contact between the stage bracket 88 and trigger bar 72. In a more general sense, note that the contact surfaces can be defined by a substantially planar surface for the trigger bar 72 and curvilinear surfaces for each of the first stage feature 92 and second stage feature 96 of the stage bracket 88. The curvilinear surface of the second stage feature 96, in some embodiments, is positioned above or otherwise concentric about the pin 86 when stage bracket 88 is installed on the trigger blade 84. As a result, the height of the second stage feature 96 relative to the trigger blade 84 varies slightly (or not all) as the stage bracket 88 is pivoted about pin 86 based on contact with the adjustment screw 102, as described below herein. In other embodiments, the stage bracket 88 may include moving surfaces such as rolling element bearings rather than curvilinear surfaces. The rolling element bearings can reduce friction and improve feel by eliminating sliding friction between the stage bracket 88 and the trigger bar 72. Numerous other trigger stage bracket configurations will be apparent in light of the present disclosure.

Referring back to FIGS. 4A-4C, the trigger blade 84 also includes an adjustment screw 102 that can be installed to adjust the position and/or angle of the stage bracket 88 relative to the trigger blade 84. In an example embodiment, the trigger blade 84 includes a pressed insert 100 for receiving the adjustment screw 102, but this is not always the case. Pressed insert 100 can include internal threads to receive the external threads of adjustment screw 102. The adjustment screw 102 is to be installed within the trigger blade 84 and insert 100 to provide a manner in which to adjust the position of the stage bracket 88 relative to the trigger blade 84. In an example embodiment, the adjustment screw 102 is a set screw (e.g., a flat point, hex drive M3 X 8). In a general sense, the adjustment screw 102 can be any fastener capable of being adjustably installed within the trigger blade 84 and provide sufficient contact with the stage bracket 88 to cause the trigger bar 72 to move when the trigger assembly 80 is operated. Also note that unlike previous devices with two or more adjustment screws, trigger assembly 80 can be limited to a single adjustment screw 102 that can be intuitively adjusted by a user. The previous devices often caused users to make improper adjustments because they did not know whether to adjust one or both of the fasteners and more importantly, users did not understand how adjusting one fastener would affect previous adjustments made with the other. Thus, adjustable trigger assembly 80 having a single adjustment screw 102 allows a user to intuitively adjust trigger feel without requiring the user to have a sophisticated understanding of the operation of the trigger assembly 80.

The stage bracket 88 can be re-positioned relative to the trigger blade 84 by changing the position of the adjustment screw 102 within the trigger blade 84. For instance, by threading (or raising) the adjustment screw 102 further within the trigger blade 84, the adjustment screw 102 moves the first stage feature 92 farther away from (or above) the trigger blade 84. As a result, the first stage feature 92 remains in contact with the trigger bar 72 through a greater portion of the trigger blade movement. This adjustment causes a user to experience a lower amount of resistance (e.g., a lighter trigger feel) through a longer portion of the trigger blade movement. In contrast, unthreading (or lowering) the adjustment screw 102 within the trigger blade 84 causes the first stage feature 92 to be positioned closer to the trigger blade 84. With the first stage feature 92 at a lower position relative to the trigger blade 84, the first stage feature 92 contacts the trigger bar 72 through a smaller portion of the trigger blade travel causing a transition from the first stage feature 92 to the second stage feature 96 to occur earlier within the travel of the trigger blade 84. As a result, the user would experience the higher amount of resistance (e.g., a heavier trigger feel) associated with the second stage feature 96 sooner and through a longer portion of the trigger blade movement.

The position of the stage bracket 88 relative to the trigger blade 84, in some embodiments, is limited to prevent a user from incorrectly or otherwise over adjusting the trigger mechanism 60. An over adjustment, for example, could result in the stage bracket 88 being positioned at such a height above the trigger blade 84 that the first stage feature 92 moves the trigger bar 72 with very little movement of the trigger blade 84, and thereby firing the air gun 10. In such a case, the air gun 10 could be adjusted to an unsafe condition because a user may inadvertently fire the air gun 10 due to the relatively short trigger movement needed to fire the gun 10. To prevent incorrect adjustments to the trigger mechanism 60, the trigger blade 84 can include one or more projections 104A and 104B (collectively 104), such as those seen in FIGS. 4A and 4B, to limit stage bracket position relative to the trigger blade 84. In an example embodiment, the projection 104A prevents the first stage feature 92 of the stage bracket 88 from being adjusted too far above the trigger blade 84 by contacting members 98 of the stage bracket 88 (shown in FIG. 5). Similarly, the trigger blade 84 can also include a projection 104B, that prevents the first stage feature 92 of the stage bracket 88 from being adjusted too far below the second stage feature 96. In such situations, the projection 104B would contact members 98 of the stage bracket 88 and position the stage bracket 88 at a minimum height relative to the second stage feature 96, regardless of the position of the adjustment screw 102 within the trigger blade 84. In a general sense, note that the range of adjustment for the stage bracket 88 can be mechanically limited in either or both directions independent of the length of the adjustment screw 102. Numerous other trigger mechanism configurations will be apparent in light of the present disclosure.

Figure 6A:
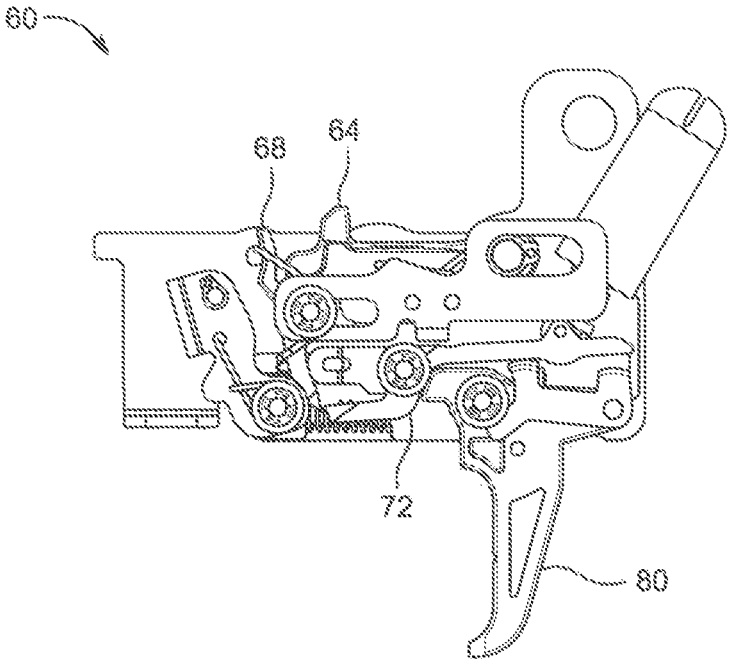
FIG. 6A is a side view of the trigger mechanism illustrating a ready-to-fire position of the trigger assembly, in accordance with an embodiment of the present disclosure.
Figure 6B:
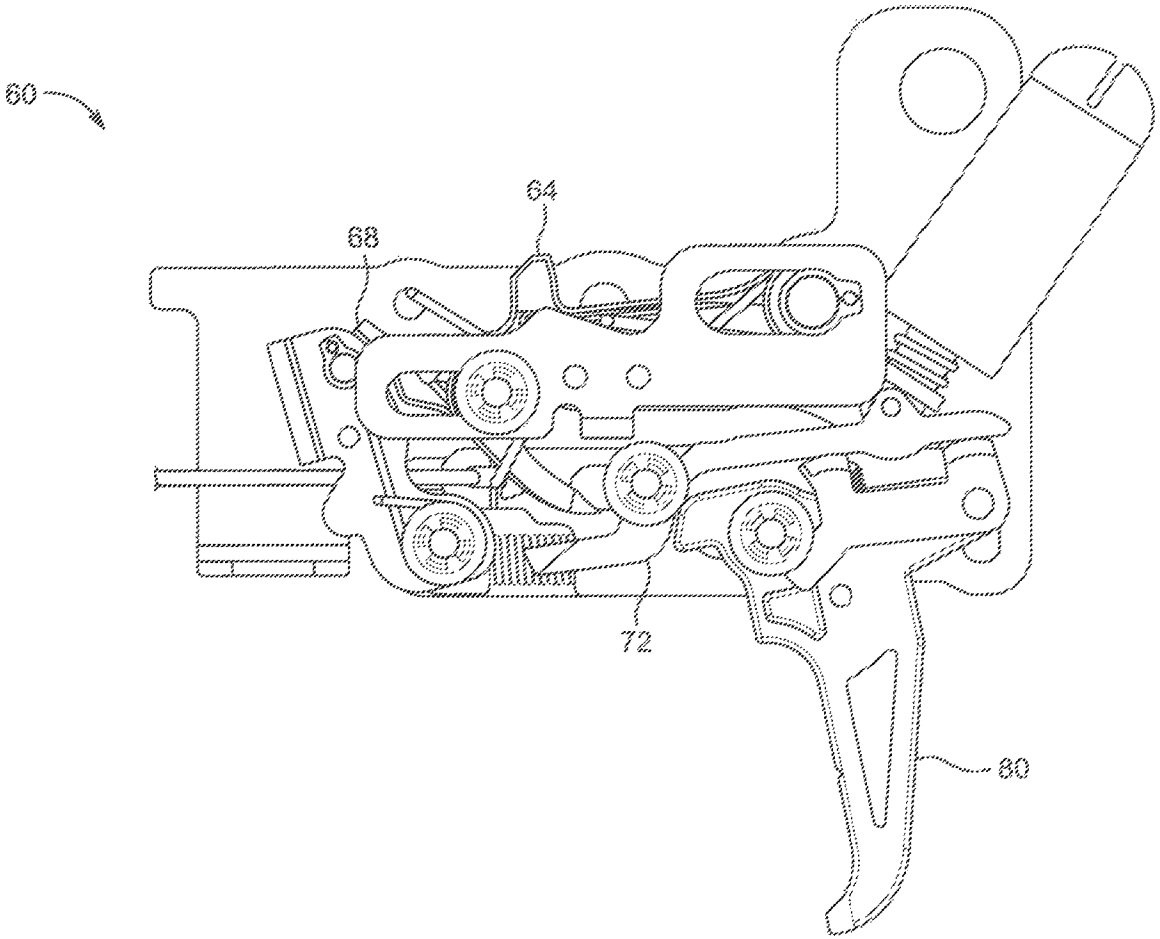
FIG. 6B is a side view of the trigger mechanism illustrating a fired position of the trigger assembly, in accordance with an embodiment of the present disclosure.

FIG. 6A is a side view of the trigger mechanism 60 illustrating an initial position of the trigger assembly 80, in accordance with an embodiment of the present disclosure. FIG. 6B is a side view of the trigger mechanism 60 illustrating a final position of the trigger assembly 80. The air gun 10, in an example embodiment, moves from a ready to fire position to a fired position that causes a projectile to be launched from the barrel 40 of the gun 10. In more detail, the air gun 10 is initially positioned in a ready to fire or cocked position. In such a position, as shown in FIG. 6A, the trigger blade 84 of the trigger assembly 80 is substantially perpendicular to the trigger bar 72. The first stage (forward) feature 92 of the stage bracket 88 is in contact with the trigger bar 72 while the second stage feature 96 of the stage bracket 88 is not. The trigger bar 72 is in further contact with the sear support 68 and prevents the support 68 from rotating. As can be seen, the sear support 68 is also in contact with the sear 64 causing the sear 64 to hold the pump piston of the compression cylinder 50 in the ready to fire position. Operation of the trigger assembly 80 causes the trigger bar 72 and sear support 68 to rotate, which in turn causes the sear 64 to release the pump piston to fire the air gun 10.

The trigger assembly 80 can be configured as either a single pull or a double pull stage trigger. If the trigger stage bracket 88 is adjusted for a single pull stage, then the trigger blade 84 may be operated through a portion or the entire distance of trigger blade travel, depending on its configuration. For instance, the trigger assembly 80 can be configured to provide less resistance (or in other words a lighter trigger feel) to a user, by threading the adjustment screw 102 further into the trigger blade 84, such that only the first stage feature 92 of the trigger stage bracket 88 contacts the trigger bar 72 during the operation of the trigger assembly 80. As a result, the trigger assembly 80 can fire the air gun 10 without the trigger assembly 80 moving its entire distance of travel. In other instances, the trigger assembly 80 can be configured as a single pull stage trigger, but with more resistance (or heavier trigger feel). In such instances, the adjustment screw 102 can be lowered such that the first stage feature 92 no longer contacts the trigger bar 72 during operation of the trigger assembly 80. Rather, the trigger assembly 80 is operated through its full range of travel, such that the second stage feature 96, and only the second stage feature 96, of the stage bracket 88 contacts the trigger bar 72, which in turn causes the trigger bar 72 to rotate beginning the firing cycle for the air gun 10.

When configured as a two pull stage trigger, the user experiences low resistance (or light trigger feel) during a primary stage of operating the trigger assembly 80 (e.g., grasps and pulls the trigger blade) due to the contact between the first stage feature 92 and trigger bar 72. As the trigger blade 84 moves further backwards, the stage bracket 88 and the trigger blade 84 rotate, increasing the resistance experienced by the user. At one point during this length of travel, called a transition point, the second stage feature 96 contacts the trigger bar 72 causing the user to experience a significant increase in resistance (heavy trigger feel). The distance at which the transition point occurs varies depending on the position of the stage bracket 88 relative to the trigger blade 84. For instance, the transition point can occur at 95% of the distance for full trigger blade travel. In other instances, the transition may occur at 80%, 85%, 96% or 98% of distance of travel for trigger blade 84 depending on the configuration of the trigger assembly 80. With the second stage feature 96 in contact with the trigger bar 72, the user experiences additional resistance (trigger weight) from internal resistance of trigger mechanism components (e.g., frictional and mechanical forces) that oppose the movement of components from the ready to fire position to the fired position.

In the fired position, as can be seen in FIG. 6B, the trigger mechanism 60 is rotated, which in turn has caused the trigger bar 72 to rotate downwardly. In more detail, the force applied by the user to the rotate the trigger blade 84 is sufficient to overcome the internal resistance of trigger mechanism components and thus cause the trigger bar 72 to rotate. Depending on the configuration of the trigger assembly 80 (e.g., a single (heavy or light resistance) or a double pull stage trigger), the first or second stage feature of the stage bracket 88 or a combination thereof can be in contact with the trigger bar 72 during operation of the trigger assembly 80 and cause the trigger bar 72 to rotate. Once rotated, the trigger bar 72 no longer retains or otherwise holds the sear support 68 in the ready to fire position. When no longer restrained by the trigger bar 72, the sear support 68 is free to rotate in a counter-clockwise direction in response to the applied spring force. With the sear support 68 rotated, the sear 64 is no longer supported, and thus it rotates downwardly and in turn releases the piston pump within the compression cylinder 50 to fire the air gun 10.

Example Trigger Adjustment Assembly

Figure 7A:
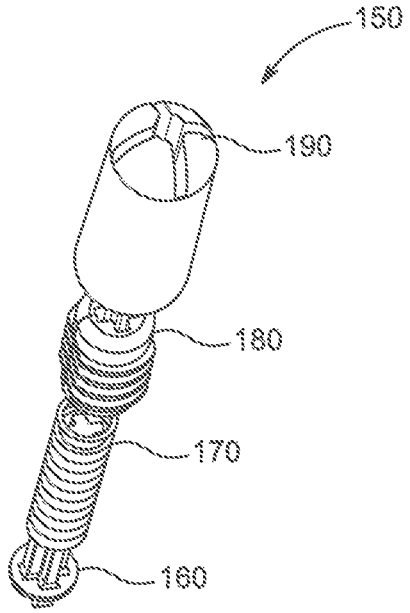
FIG. 7A is an exploded view of a trigger adjustment assembly configured in accordance with an embodiment of the present disclosure.
Figure 7B:
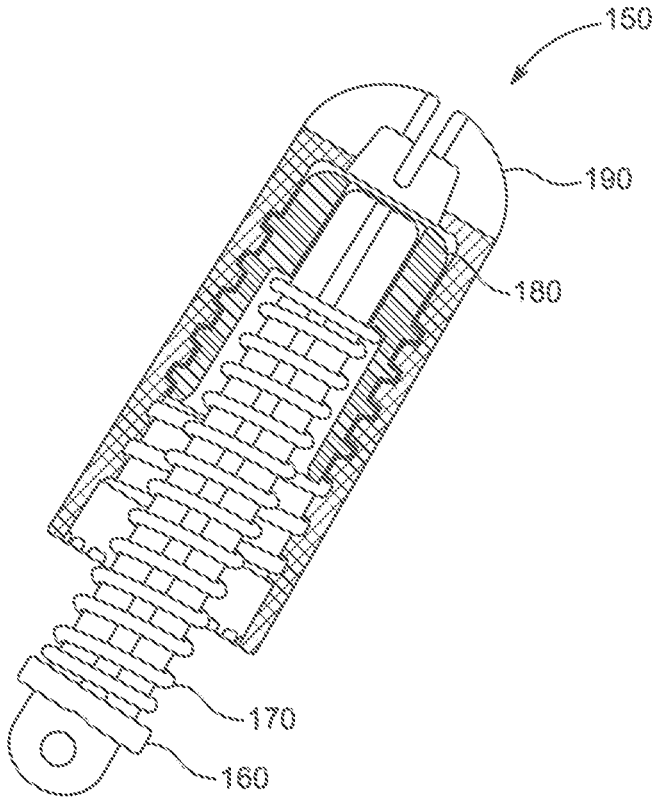
FIG. 7B is a cross-sectional view of the trigger adjustment assembly shown in FIG. 7A, in accordance with an embodiment of the present disclosure.

FIG. 7A is an exploded view of a trigger adjustment assembly 150 configured in accordance with an embodiment of the present disclosure. FIG. 7B is a cross-sectional view of the trigger adjustment assembly 150 shown in FIG. 7A. In a general sense, the trigger adjustment assembly 150 can vary the resistance (or in other words trigger pull weight) experienced by a user while operating the trigger assembly 80 (e.g., grasping and pulling the trigger) through the first pull stage. Thus, the user can adjust the trigger assembly 80 to achieve a smooth and comfortable trigger feel as trigger assembly operation transitions from a first to a second pull stage. The trigger adjustment assembly 150, in more detail, allows a user to maintain a substantially constant or otherwise nearly uniform resistance (in other words trigger pull) during each of the pull stages for the trigger assembly operation. In addition, as the trigger blade 84 transitions from the first to the second pull stage the amount of resistance experienced by the user can increase, this in turn can indicate to the user that the trigger blade 84 is nearing the distance at which it will fire the air gun 10. The trigger adjustment assembly 150 can be adjusted in discrete steps such that the user can tailor trigger assembly operation to a desired trigger feel. Such adjustments not only provide a desired trigger feel, but are also easily replicated. This can be helpful during instances in which the trigger assembly 80 is disassembled for repair or maintenance. Using the discrete adjustment steps, the user can determine how the trigger assembly 80 is presently adjusted and can easily reproduce those adjustments to achieve the previous trigger assembly condition. In addition, the trigger adjustment assembly 150 is accessible from the top of the air gun 10. Accessing the trigger adjustment assembly 150 from the top of the air gun 10 is more convenient for users, because they do not have to place the air gun 10 down and rotate it to make an adjustment. Rather, the air gun 10 can simply be lowered to access the trigger adjustment assembly 150.

In an example embodiment, the trigger adjustment assembly 150 includes a stem 160, a spring 170, an adjustment collar 180, and a spherical adjustment cap 190. As can be seen, the trigger adjustment assembly 150 is at an angle not normal to the trigger bar (e.g., 60 degrees). Thus, a portion of the total force provided by the trigger adjustment assembly 150 is resisting counter clockwise rotation of the trigger bar 72. In more detail, as the trigger bar 72 rotates in counterclockwise direction the angle between the trigger adjustment assembly 150 and the trigger bar 72 decreases. In turn, the portion of the force applied by the trigger adjustment assembly 150 (in other words the normal component of the assembly force) opposing the rotation of the trigger bar 72 decreases (partially or fully), despite an increase in spring force caused by the further compression of the spring 170 as the stem 160 moves axially within the adjustment collar 180. As a result, the resistance during the operation of the trigger blade 84 (the pull force) is substantially constant or otherwise nearly uniform through the first and second pull stages of trigger blade travel. Note, that there is discrete and substantial increase in resistance as the trigger blade transitions from first to second pull stage, but that during each pull stage the resistance remains substantially constant or otherwise nearly uniform. Other trigger adjustment assembly configurations will be apparent in light of the present disclosure.

Figure 8:
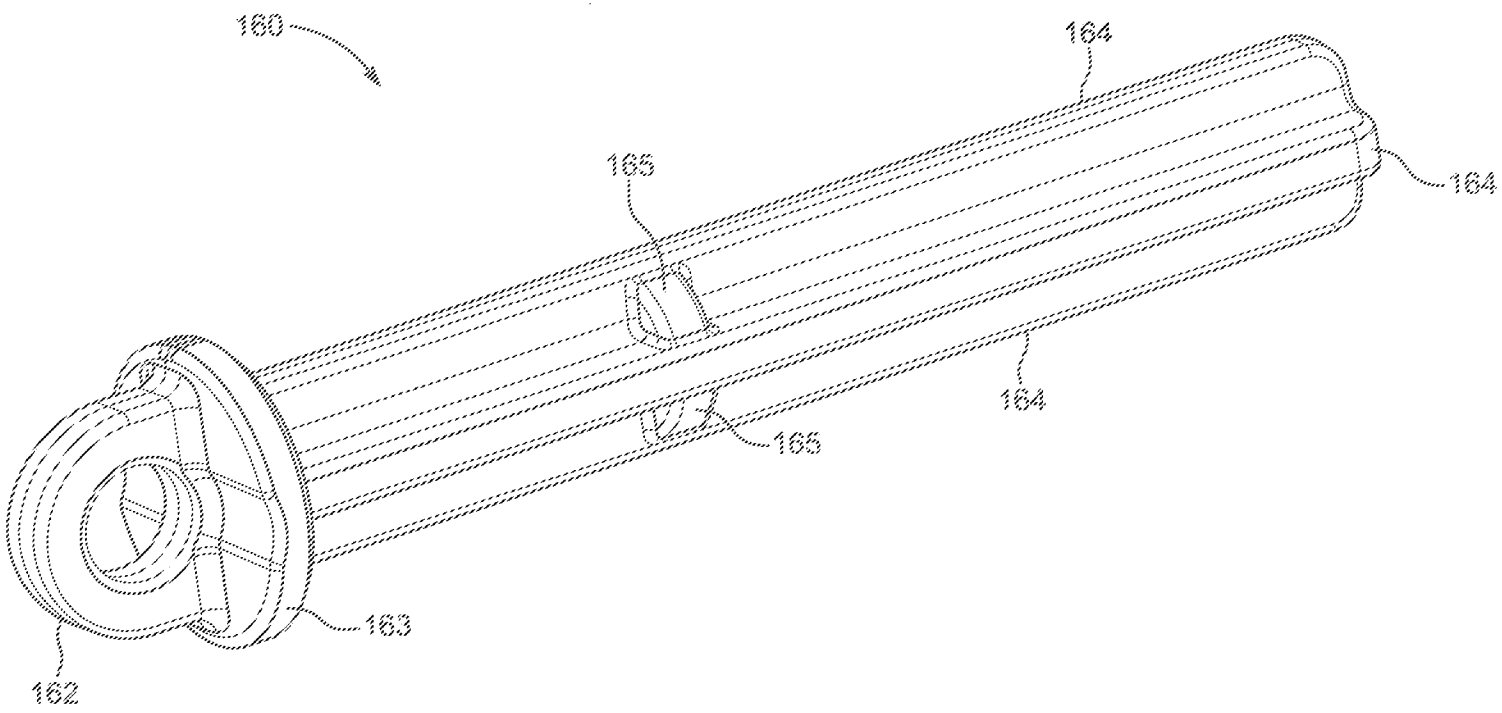
FIG. 8 is a perspective view of a stem for the trigger adjustment assembly configured in accordance with an embodiment of the present disclosure.

FIG. 8 is a perspective view of a stem 160 for the trigger adjustment assembly 150 configured in accordance with an embodiment of the present disclosure. Stem 160 pivotally connects the trigger adjustment assembly 150 to the trigger bar 72. The force applied by the trigger adjustment assembly 150 to the trigger bar 72 causes the trigger bar 72 to oppose the movement of the trigger assembly 80 towards the fired position. Thus, the trigger adjustment assembly 150 maintains the trigger bar 72 in the ready to fire position, as previously described herein, until movement of the trigger assembly 80 causes the trigger bar 72 to rotate, which in turn fires the air gun 10. In an example embodiment, the stem 160 receives a spring 170 and constrains one end of the spring 170 at collar 163. The stem 160 can be manufactured from plastic materials, such as acetal homopolymer resin, or other materials such as composite or metallic materials with sufficient mechanical properties to withstand the forces applied to the stem 160. The stem 160 includes an attachment point 162, a collar 163, one or more longitudinal tabs 164, and stops 165. The attachment point 162 connects the stem 160 to the trigger bar 72. In this example case, the attachment point 162 includes a hole and is configured to be received by or otherwise attached to the trigger bar 72 using a fastener, such as a pin or rivet. Note that in this configuration, the attachment point 162 allows the end of the stem 160 to rotate (with low friction) in relation to the trigger bar 72 while the trigger bar 72 is rotating (in the counterclockwise direction) in response to moving the trigger blade 84. The rotation of the stem 160 relative to the trigger bar 72 in turn, causes the stem 160 to move axially within the adjustment collar 180, and thus compressing the spring 170. As a result, the spring force transmitted by the stem 160 onto the trigger bar 72 increases. Although the spring force applied to the trigger bar 72 has increased, the angle of the stem 160 relative to the trigger bar 72 has decreased due to the rotation of the stem 160 relative to the trigger bar 72. As a result, the normal component of the force responsible for opposing trigger bar rotation decreases, and thus maintains the resistance for operating the trigger blade 84 (trigger pull force) substantially constant or otherwise nearly uniform during the travel of the trigger blade 84 through each of the pull stages. As the trigger blade 84 transitions from the first to the second pull stage, however, there is an increase in the resistance to operate the trigger blade 84.

As can be seen, adjacent to the attachment point 162 is a collar 163 for receiving one end of the spring 170. The collar 163 transmits forces from the spring 170 onto the stem 160. Extending from the collar 163 are one or more longitudinal tabs 164. Longitudinal tabs 164 are configured to center and align the spring 170 and to mate with an adjustment collar 180 and prevent it from rotating about the stem 160, as will be described further herein. The longitudinal tabs 164 can be of any length sufficient to allow the adjustment collar 180 to be variously positioned along the stem 160 while operating the trigger adjustment assembly 150. As can be seen, the longitudinal tabs 164 can extend from the collar 163 to the opposite end of the stem 160, but this is not so in all cases. Disposed on the longitudinal tabs 164 are one or more stops 165 configured to limit the travel of the adjustment collar 180 along the stem 160. The stops 165 are positioned along the stem 160 such that when the adjustment collar 180 contacts the stops 165, the spring 170 is not fully compressed, and thus allows the spring 170 to be further compressed in response to the stem 160 moving axially within adjustment collar 180 during operation of the trigger blade 84. Numerous other stem configurations will be apparent in light of this disclosure.

Disposed on the stem 160 is a resilient member, such as spring 170. Spring 170 is configured to apply a force onto the stem 160 causing the trigger bar 72 to oppose the movement of the trigger assembly 80. As a result, the user experiences a substantially constant or otherwise nearly uniform resistance (or trigger feel) while operating the trigger blade 84 through the first and second pull stages of the trigger assembly 80 and an increase in resistance when transitioning from the first to the second pull stage. The position of the trigger adjustment assembly 150 relative to the trigger mechanism 60 allows the spring 170 to be adjusted through a distance, for example 10 millimeters (mm), and can be manufactured with a low spring rate, such as 586 Newton per meters (N/m). In an example embodiment, the spring 170 is a closed-end spring manufactured from metallic material, such as music wire. Numerous other resilient member configurations will be apparent in light of the present disclosure.

Figure 9A:
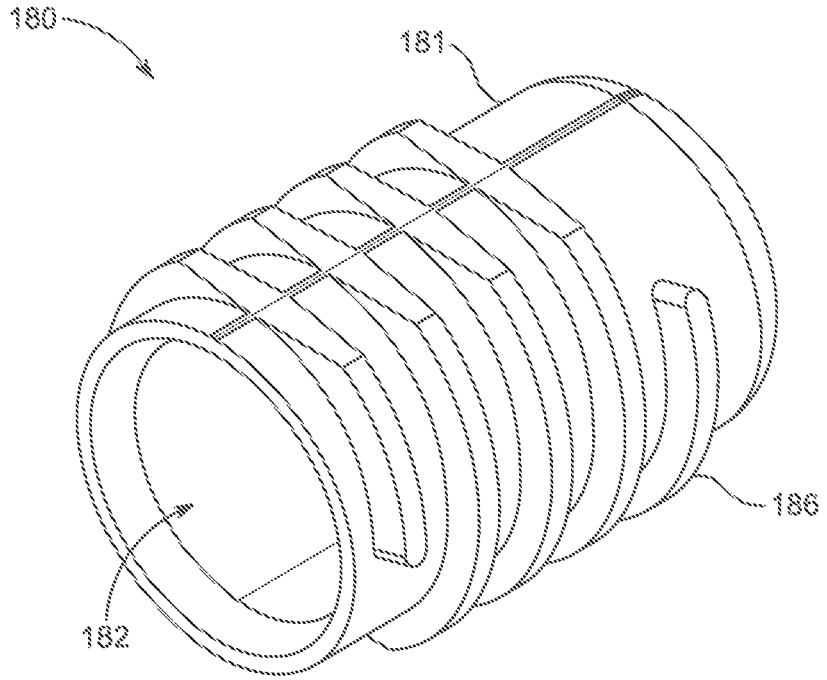
FIG. 9A is a perspective view of an adjustment collar for the trigger adjustment assembly configured in accordance with an embodiment of the present disclosure.
Figure 9B:
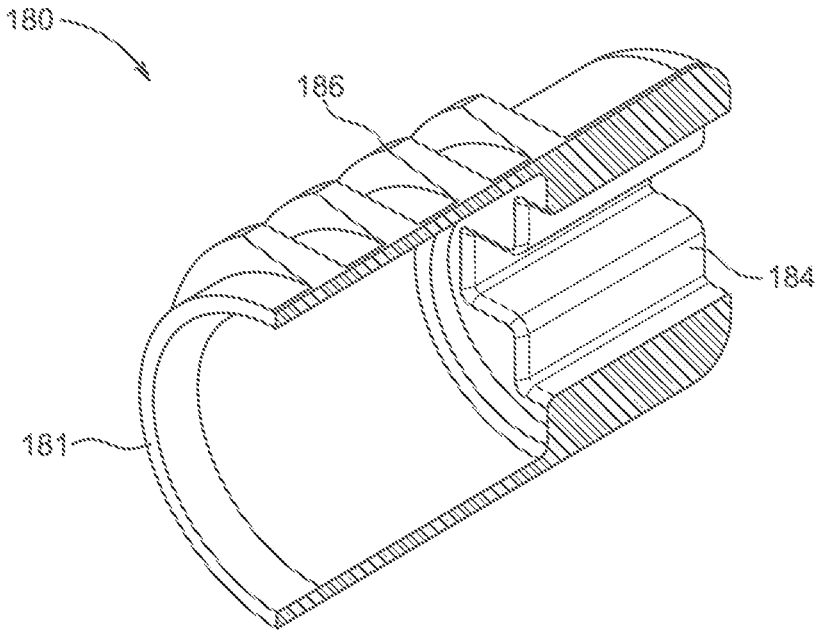
FIG. 9B is a cross-sectional view of the adjustment collar shown in FIG. 9A, in accordance with an embodiment of the present disclosure.
Figure 9C:
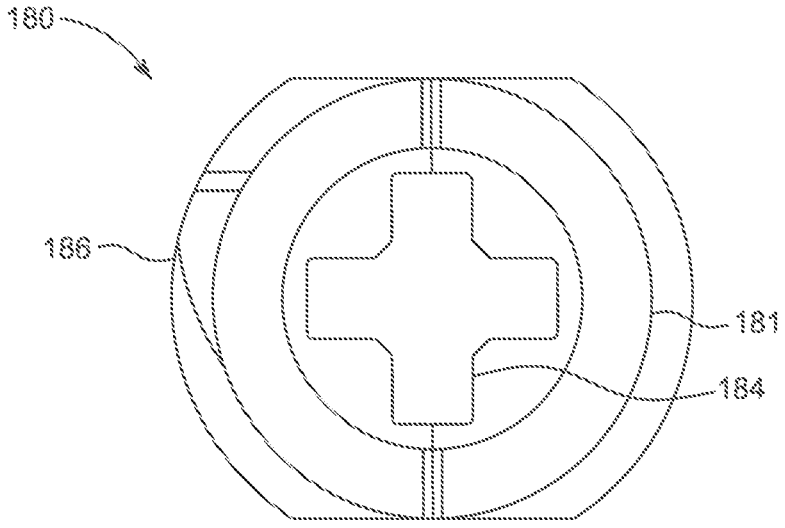
FIG. 9C is an end view of the adjustment collar shown in FIG. 9A, in accordance with an embodiment of the present disclosure.

FIG. 9A is a perspective view of an adjustment collar 180 for the trigger adjustment assembly 150 configured in accordance with an embodiment of the present disclosure. FIG. 9B is a cutaway view of the adjustment collar 180 shown in FIG. 9A. FIG. 9C is an end view of the adjustment collar 180 shown in FIG. 9A. The adjustment collar 180 is generally configured to constrain or otherwise retain the second end of the spring 170. In addition, the adjustment collar 180 also interfaces with spherical adjustment cap 190, such that the adjustment collar 180 is variably positioned along the stem 160, as described further herein. The adjustment collar 180 can be manufactured from polymeric materials, such as acrylonitrile butadiene styrene (ABS). In an example embodiment, the adjustment collar 180 includes a body 181 defining a cavity 182. The body 181 can be any shape or form-factor that enables the adjustment collar 180 to interface with the stem 160, spring 170, and spherical adjustment cap 190. As can be seen, the body 181 includes a cavity 182 for receiving the stem 160 and spring 170. The body 181 also includes a locking feature 184 and external threads 186. The locking feature 184 is configured to engage the stem 160 and prevent the adjustment collar 180 from rotating about the stem 160. In this example case, the locking feature 184 includes one or more grooves or channels for receiving the longitudinal tabs 164 of the stem 160. With the adjustment collar 180 positioned onto the stem 160, the locking feature 184 permits the adjustment collar 180 to slide axially or otherwise move along, but not rotate about, the stem 160. The body 181 also includes external threads 186 disposed on an outer surface (or outside diameter). External threads 186 are configured to engage or otherwise mate with threads disposed within the spherical adjustment cap 190, as described further herein. Numerous other adjustment collar configurations will be apparent in light of the present disclosure.

Figure 10A:
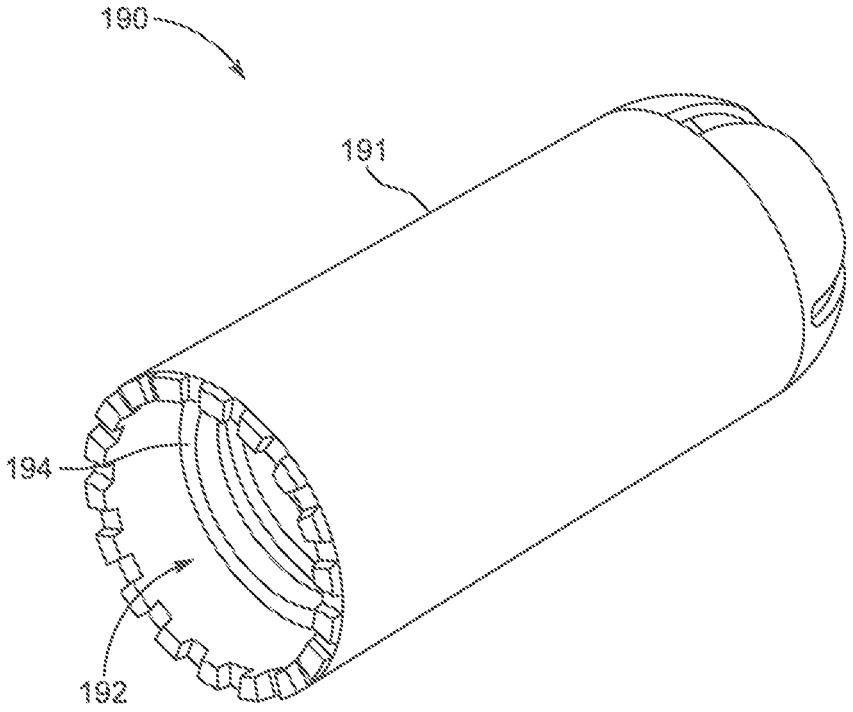
FIG. 10A is a perspective view of a spherical adjustment cap for the trigger adjustment assembly configured in accordance with an embodiment of the present disclosure.
Figure 10B:
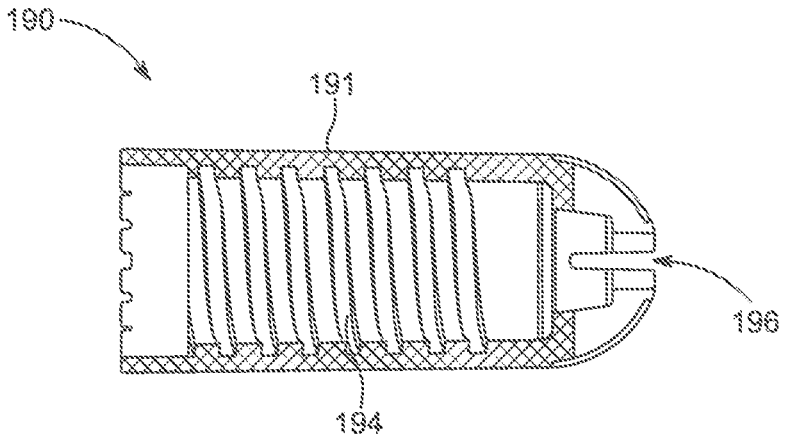
FIG. 10B is a cross-sectional view of the spherical adjustment cap shown in FIG. 10A, in accordance with an embodiment of the present disclosure.
Figure 10C:
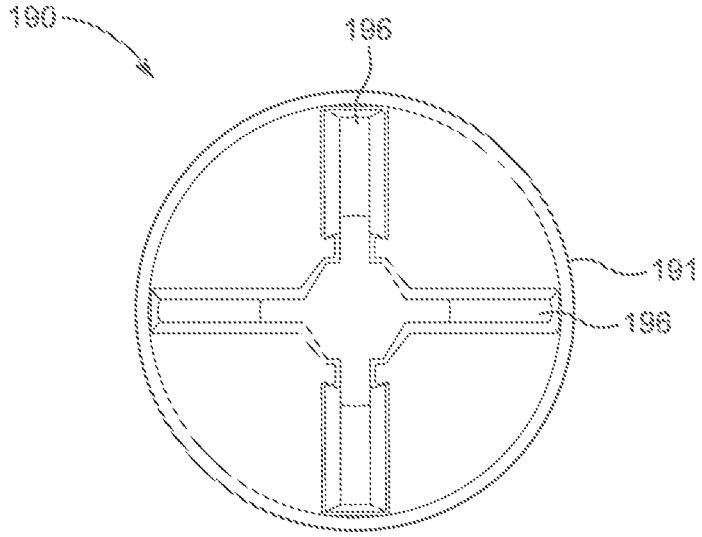
FIG. 10C is an end view of the spherical adjustment cap shown in FIG. 10A, in accordance with an embodiment of the present disclosure.

FIG. 10A is a perspective view of an adjustment cap 190 for the trigger adjustment assembly 150 configured in accordance with an embodiment of the present disclosure. FIG. 10B is a cross-sectional view of the adjustment cap 190 shown in FIG. 10A. FIG. 10C is an end view of the adjustment cap 190 shown in FIG. 10A. In a general sense, the spherical adjustment cap 190 is configured to adjust the position of the adjustment collar 180 along the stem 160. The spherical adjustment cap 190 can be manufactured from plastic materials, such as acetal homopolymer resin, or other materials, such as composite or metallic materials, with sufficient mechanical properties to retain the adjustment collar 180 in place along the stem 160. Depending on how it is adjusted, the spherical adjustment cap 190 may cause the adjustment collar 180 to compress or relax the spring 170. As result, the forces applied by the spring 170 onto the stem 160 can be varied to achieve a desired trigger feel. In addition, the spherical adjustment cap 190 is accessible from the top of the air gun 10 through piston plug 62, as described further herein. Such accessibility allows a user to easily adjust the trigger adjustment assembly 150 without having to rotate or disassemble the air gun 10.

In an example embodiment, the spherical adjustment cap 190 includes a body 191 defining a cavity 192 with internal threads 194 disposed therein. Body 191 can be any shape capable of receiving the adjustment collar 180 within the cavity 192. As can be seen, body 191 is a cylindrical body with cavity 192 disposed therein. Cavity 192 is configured to receive the adjustment collar 180 and stem 160, such that the adjustment collar 180 can move along both the stem 160 and the internal threads 194 of the spherical adjustment cap 190. In more detail, internal threads 194 are configured to engage the external threads 186 of the adjustment collar 180. As described further herein, the spherical adjustment cap 190 can be rotated, such that the contact between internal threads 194 and the external threads 186 of the adjustment collar 180 cause the adjustment collar 180 to move along the stem 160. In addition, body 191 further includes one or more slots or grooves 196. Grooves 196 are disposed on an end of the body 191 opposite the end that includes the opening for the cavity 192. Grooves 196 are configured to receive an input from a user, for instance an end of a screw driver or Allen wrench. As can be seen, the grooves 196 are substantially perpendicular to one another, but do not have to be in all cases. In a general sense note that the grooves 196 can be arranged in any pattern or style, such that the user can manipulate the position the spherical adjustment cap 190 using the grooves 196, as described below. Numerous other configurations for the spherical adjustment cap 190 will be apparent in light of the present disclosure.

Figure 11A:
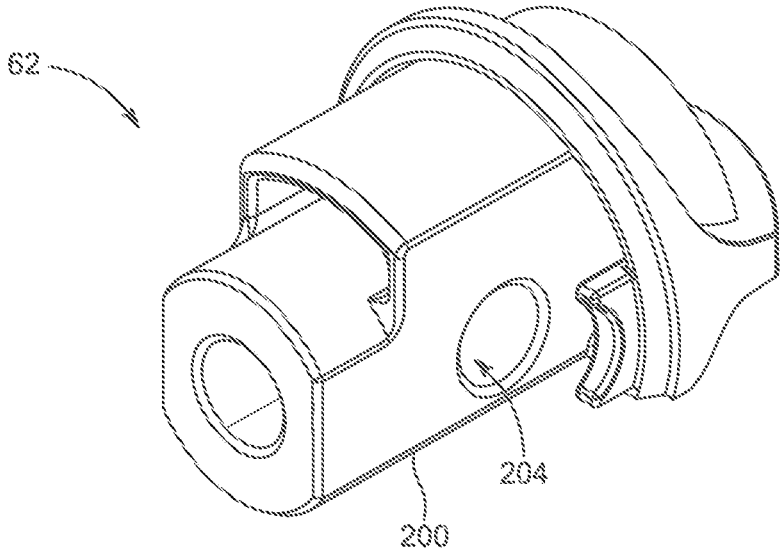
FIG. 11A is a perspective view of a piston plug for the action assembly of the air gun shown in FIG. 2, in accordance with an embodiment of the present disclosure.
Figure 11B:
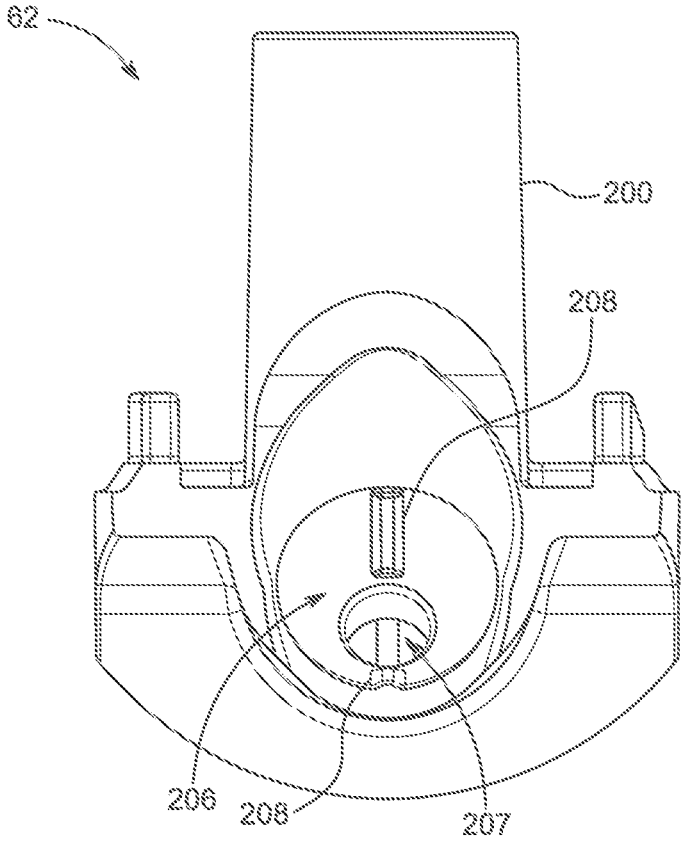
FIG. 11B is a bottom view of the piston plug shown in FIG. 11A, in accordance with an embodiment of the present disclosure.

FIG. 11A is a perspective view of a piston plug 62 for the action assembly 20 of the air gun 10 shown in FIG. 1, in accordance with an embodiment of the present disclosure. FIG. 11B is a bottom view of the piston plug 62 shown in FIG. 11A. The compression cylinder 50 of the air gun 10 includes a piston plug 62 configured to fix the position of spherical adjustment cap 190 relative to the stem 160, which in turn allows the stem 160 to move within the adjustment collar 180 in response to rotating the trigger assembly 80. The piston plug 62 can be manufactured from, for example, metals, such as carbon steel, corrosion-resistant steel, or other cast metals, for instance zinc. In an example embodiment, the piston plug 62 includes a body 200 having an opening 204 for receiving a pin 63 used to mount the piston plug 62 to the compression cylinder 50. Within a bottom surface of piston plug 62 is a recess 206 that includes a hole 207 and tabs 208. The hole 207 is a through-hole that extends from the recess 206 to a top surface of the piston plug 62. The hole 207 is configured to allow a user to access (e.g., using a screw driver) the grooves 196 of the spherical adjustment cap 190. Adjacent to the hole 207 is one or more tabs 208. Tabs 208 are configured to engage the grooves 196 of the spherical adjustment cap 190 to prevent it from rotating. As can be seen, in an example embodiment, the piston plug 62 includes two tabs 208 aligned with one another on either side of the hole 207. In some other instances, there may be only one tab 208 disposed at a location adjacent to the hole 207. Note that although the spherical adjustment cap 190 is engaged with the tabs 208, the spherical adjustment cap 190 can pivot or move relative to the piston plug 62 with low friction resistance. This movement of the spherical adjustment cap 190 within the piston plug 62 facilitates or otherwise enables the stem 160 to rotate about the trigger bar 72 during movement of the trigger blade 84. Numerous other piston plug configurations will be apparent in light of the present disclosure.

Figure 12A:
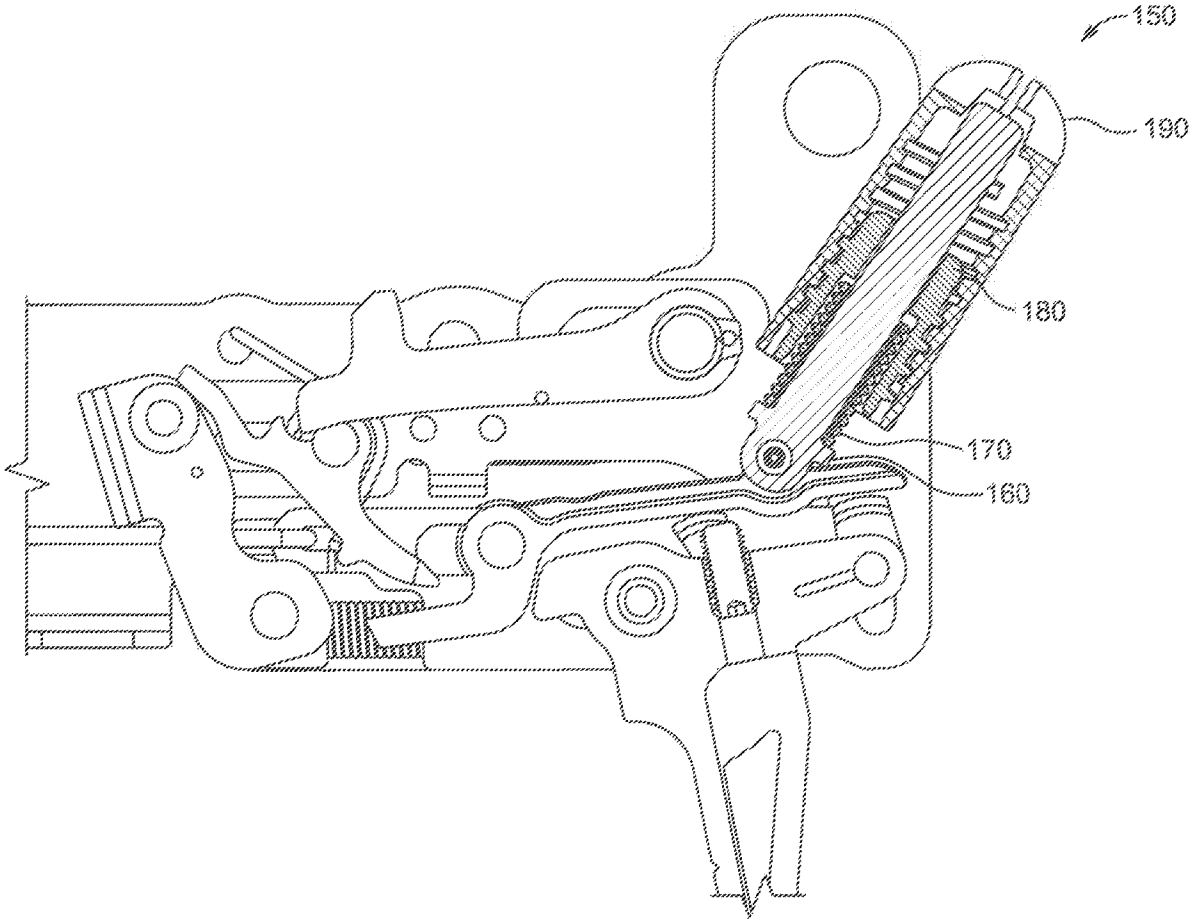
FIG. 12A is a side view of the trigger mechanism illustrating a maximum pre-load position of the trigger adjustment assembly, in accordance with an embodiment of the present disclosure.
Figure 12B:
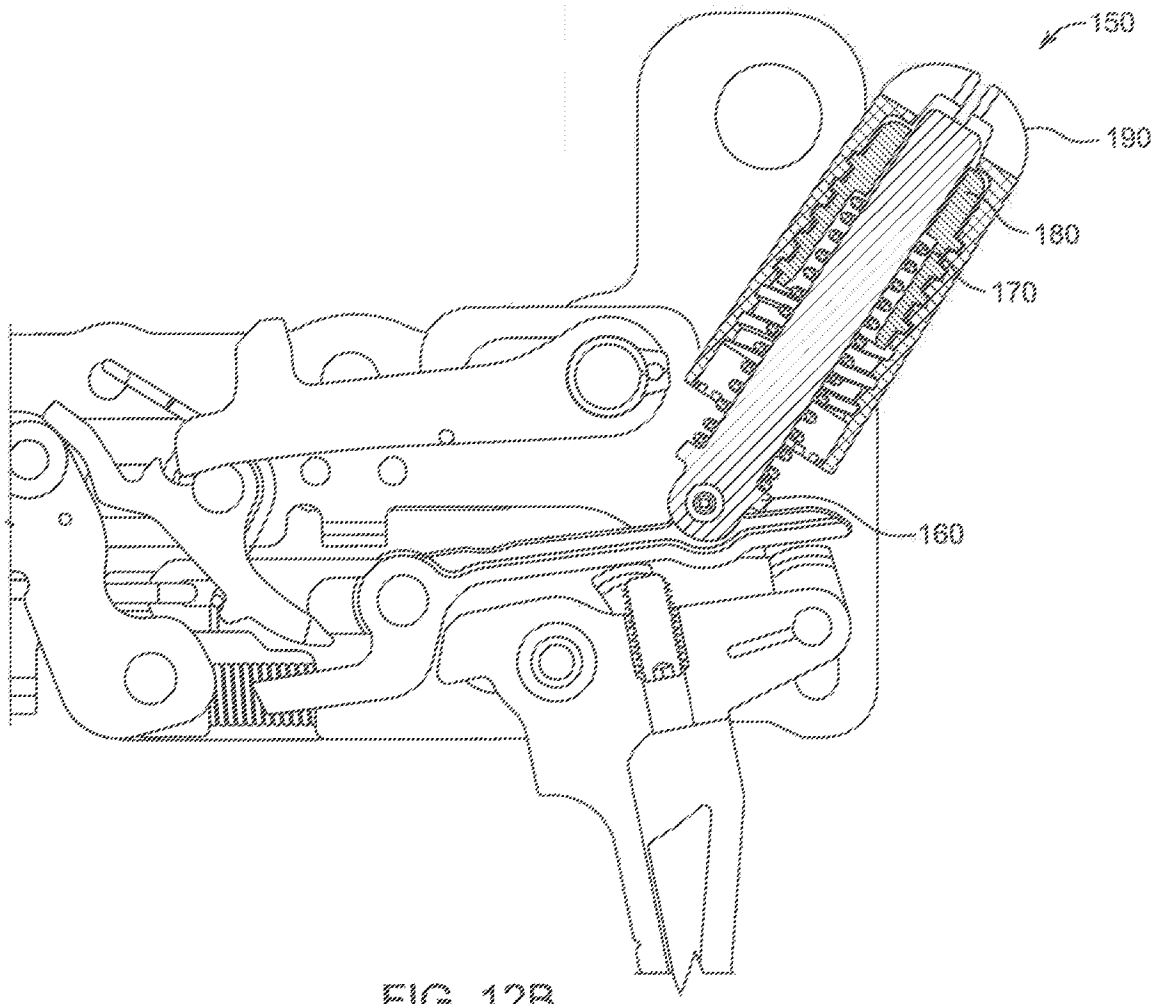
FIG. 12B is a side view of the trigger mechanism illustrating a minimum pre-load position of the trigger adjustment assembly, in accordance with an embodiment of the present disclosure.

FIG. 12A is a side view of the trigger mechanism 60 illustrating a maximum pre-load position of the trigger adjustment assembly 150, in accordance with an embodiment of the present disclosure. FIG. 12B is a side view of the trigger mechanism 60 illustrating a minimum pre-load position of the trigger adjustment assembly 150. In general, the user can adjust the pre-load force applied to the trigger bar 72 by using a tool, such as a screw driver, to engage the spherical adjustment cap 190, as previously described. Once engaged, the tool can be pressed down causing the spherical adjustment cap 190 to move downward relative to the piston plug 62 and in a direction along the stem 160. Once the grooves 196 of the spherical adjustment cap 190 are clear or otherwise free from the tabs 208 disposed within the recess 206 of the piston plug 62, the user can rotate the adjustment cap 190 in either direction relative to the piston plug 62 and about the stem 160. The spherical adjustment cap 190 can be rotated in discrete increments, such as 180 degree increments, to achieve a desired pre-load (or force) on the trigger bar 72. Fine or coarse thread pitches in the spherical adjustment cap 190 and adjustment collar 180 can be selected to adjust the amount of throw per degree increment and to adjust the force required to rotate the adjustment cap 190. Depending on the direction of rotation, the spherical adjustment cap 190 can position the adjustment collar 180 so as to increase or decrease the pre-load applied to the trigger bar 72, and thus achieve a particular level or amount of resistance (e.g., a heavier or lighter trigger feel) when the trigger assembly 80 is operated. As a result, the trigger blade 84 can be operated with a resistance (or in other words a pull force) that is substantially constant or otherwise nearly uniform during the first and second pull stages. In addition, as the trigger blade 84 transitions from the first pull stage to the second pull stage, the user experiences an increase in trigger feel that indicates to the user that the trigger blade 84 is now traveling through the second pull stage, and thus nearing a distance at which it fires the air gun 10.

As can be seen in FIG. 12A, the adjustment collar 180 is in the fully down position. As a result, the adjustment collar 180 is in contact with the stops 165 on the stem 160 causing the spring 170 to be almost fully compressed against stem 160, as previously described herein. In this position, the trigger adjustment assembly 150 provides a maximum pre-load force to the trigger bar 72. To achieve the maximum pre-load force, the spherical adjustment cap 190 can be rotated through several revolutions in a first direction (e.g., clockwise), thereby causing the adjustment collar 180 to move downwardly along the stem 160 to compress the spring 170.

In FIG. 12B the adjustment collar 180 is positioned at its greatest distance along the stem 160 (e.g., when collar 180 has reached the end of internal threads 194 on the spherical adjustment cap 190). As a result, the spring 170 is at its largest length, and thus provides the least amount of pre-load force to the trigger bar 72. To obtain this configuration, the spherical adjustment cap 190 can be rotated in a second direction opposite the first direction (e.g., counterclockwise) to move the adjustment collar 180 upwardly along the stem 160. As a result, the spring 170 expands and relaxes, thus reducing the amount of pre-load force applied to the trigger bar 72. In such a configuration, the resistance experienced by the user while operating the trigger assembly 80 through the first pull stage would be low at first, and would remain low, until reaching the transition point at the end of the first pull stage, at which point the resistance would suddenly increase. In other configurations, the trigger adjustment assembly 150 can be adjusted between the maximum and minimum pre-load conditions to maintain a greater resistance force for the first or second pull stage (or both) during operation of the trigger assembly.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. An air gun comprising:

a barrel attached to a cylinder; and a trigger mechanism including a sear operatively coupled to a trigger bar, the sear is configured to release a piston disposed within the cylinder in response to operating the trigger mechanism, a trigger blade operatively coupled to the trigger bar and including a trigger stage bracket, the trigger stage bracket to provide a first pull stage and a second pull stage, wherein the second pull stage operates with more resistance force than the first pull stage during movement of the trigger blade, and an adjustment screw disposed within the trigger blade and in contact with the trigger stage bracket, the adjustment screw to position of the trigger stage bracket relative to the trigger blade to adjust a distance at which the trigger blade is to transition from the first pull stage to the second pull stage.

2. The air gun of claim 1, wherein the trigger stage bracket includes a first stage feature in contact with the trigger bar during the first pull stage, and a second stage feature in contact with the trigger bar during the second pull stage.

3. The air gun of claim 2, wherein the first stage feature is in contact with the trigger bar and the second stage feature is not in contact with the trigger bar while the trigger blade is operated through the first pull stage.

4. The air gun of claim 2, wherein the first stage feature and the second stage feature are in contact with the trigger stage bracket at the distance at which the trigger blade is to transition from the first pull stage to the second pull stage.

5. The air gun of claim 2, wherein the first stage feature and the second stage feature are curvilinear surfaces.

6. The air gun of claim 2, wherein at least one of the first stage feature and the second stage feature includes a rotating bearing element.

7. The air gun of claim 2, wherein contact between the trigger bar and the trigger stage bracket is along a surface of at least one of the first stage feature and the second stage feature.

8. The air gun of claim 1, wherein the trigger blade is configured to limit movement of the trigger stage bracket relative to the trigger blade.

9. The air gun of claim 1, wherein the trigger mechanism includes only one adjustment screw to adjust the distance at which the trigger blade is to transition from the first pull stage to the second pull stage.

* * * * *